US011434937B2

(12) United States Patent
Misaki

(10) Patent No.: US 11,434,937 B2
(45) Date of Patent: Sep. 6, 2022

(54) EXCAVATOR AND CONTROL VALVE FOR EXCAVATOR

(71) Applicant: SUMITOMO(S.H.I.) CONSTRUCTION MACHINERY CO., LTD., Tokyo (JP)

(72) Inventor: Youji Misaki, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 16/135,389

(22) Filed: Sep. 19, 2018

(65) Prior Publication Data

US 2019/0017247 A1 Jan. 17, 2019

Related U.S. Application Data

(63) Continuation of application No. PCT/JP2017/011208, filed on Mar. 21, 2017.

(30) Foreign Application Priority Data

Mar. 22, 2016 (JP) ..... JP2016-057338

(51) Int. Cl.
*F15B 11/16* (2006.01)

(52) U.S. Cl.
CPC ..... *F15B 11/162* (2013.01)

(58) Field of Classification Search
CPC .. F15B 2211/781; F15B 11/162; F15B 13/022
See application file for complete search history.

(56) References Cited

U.S. PATENT DOCUMENTS

| | | | | |
|---|---|---|---|---|
| 4,875,337 | A | 10/1989 | Sugiyama et al. | |
| 5,493,950 | A | 2/1996 | Kim | |
| 5,586,577 | A | 12/1996 | Cho | |
| 5,615,991 | A * | 4/1997 | Chung | F15B 11/16 414/685 |
| 6,327,959 | B1 | 12/2001 | Takahashi et al. | |
| 6,430,922 | B2 * | 8/2002 | Tohji | E02F 9/2225 60/421 |
| 6,915,600 | B2 * | 7/2005 | Kondou | E02F 3/325 37/414 |

(Continued)

FOREIGN PATENT DOCUMENTS

| | | |
|---|---|---|
| EP | 2781661 | 9/2014 |
| EP | 2863065 | 4/2015 |

(Continued)

OTHER PUBLICATIONS

International Search Report for PCT/JP2017/011208 dated Jun. 13, 2017.

*Primary Examiner* — Thomas E Lazo
(74) *Attorney, Agent, or Firm* — IPUSA, PLLC

(57) ABSTRACT

An excavator includes a hydraulic actuator driven by hydraulic oil discharged from a main pump to move a work element; a first control valve disposed in a center bypass pipeline; a second control valve disposed in a parallel pipeline; and a control device for controlling the movement of the second control valve. The first control valve and the second control valve are formed in a valve block of control valves, and the second control valve is disposed upstream of the first control valve.

9 Claims, 11 Drawing Sheets

(56) References Cited

U.S. PATENT DOCUMENTS

| | | | | |
|---|---|---|---|---|
| 7,549,241 | B2 * | 6/2009 | Ioku | E02F 3/432 37/348 |
| 7,921,764 | B2 * | 4/2011 | Takeshita | E02F 9/2225 91/513 |
| 9,932,994 | B2 | 4/2018 | Hashimoto | |
| 2014/0245730 | A1 * | 9/2014 | Joung | E02F 9/2225 60/428 |
| 2015/0059332 | A1 | 3/2015 | Hashimoto | |
| 2015/0107712 | A1 * | 4/2015 | Kobayashi | F15B 13/0842 137/884 |
| 2016/0377098 | A1 | 12/2016 | Nakamura et al. | |

FOREIGN PATENT DOCUMENTS

| | | |
|---|---|---|
| JP | H02-000566 | 1/1990 |
| JP | H08-105404 | 4/1996 |
| JP | H11-190304 | 7/1999 |
| JP | H11-257303 | 9/1999 |
| JP | 2000-170707 | 6/2000 |
| JP | 2000-205426 | 7/2000 |
| JP | 2002-372007 | 12/2002 |
| JP | 2014-001768 | 1/2014 |
| JP | 2014-001769 | 1/2014 |
| JP | 2015-203426 | 11/2015 |

* cited by examiner

EXCAVATOR AND CONTROL VALVE FOR EXCAVATOR

CROSS-REFERENCE TO RELATED APPLICATION

The present application is a continuation of International Application No. PCT/JP2017/011208 filed on Mar. 21, 2017, which is based on and claims priority to Japanese Patent Application No. 2016-057338, filed on Mar. 22, 2016. The contents of these applications are incorporated herein by reference in their entirety.

BACKGROUND OF THE INVENTION

1. Field of the Invention

The present invention relates to an excavator provided with a hydraulic system capable of simultaneously supplying hydraulic oil discharged by one hydraulic pump to a plurality of hydraulic actuators, and a control valve for the excavator installed in the excavator.

2. Description of the Related Art

An excavator provided with a center bypass pipeline that passes through a plurality of spool valves that supply and discharge hydraulic oil to and from a plurality of hydraulic actuators is known in the related art.

Instead of individually executing bleed-off control with a spool valve corresponding to each hydraulic actuator, this excavator executes bleed-off control in a unified manner with respect to a plurality of hydraulic actuators by using a unified bleed-off valve provided at the most downstream of a center bypass pipeline. Therefore, even when each spool valve moves from a neutral position, the flow path area of the center bypass pipeline is not reduced.

Furthermore, a poppet type control valve is also provided, which is capable of limiting the flow rate of hydraulic oil flowing into the arm cylinder through a parallel pipeline, when the arm operation lever is operated.

With this configuration, in the excavator disclosed in the related art, during the composite operation including arm closing and boom raising, most of the hydraulic oil discharged by the main pump is prevented from flowing into the arm cylinder having a relatively low load pressure.

SUMMARY OF THE INVENTION

According to an embodiment of the present invention, there is provided an excavator including a lower travelling body; an upper turning body mounted on the lower travelling body; an engine installed in the upper turning body; a hydraulic pump connected to the engine; a hydraulic actuator driven by hydraulic oil discharged by the hydraulic pump to move a work element; a first spool valve configured to control a flow rate of the hydraulic oil flowing from the hydraulic pump to the hydraulic actuator and a flow rate of the hydraulic oil flowing from the hydraulic actuator to a hydraulic oil tank, the first spool valve being disposed in a center bypass pipeline; a second spool valve configured to control a flow rate of the hydraulic oil flowing from the hydraulic pump to the hydraulic actuator, the second spool valve being disposed in a parallel pipeline; and a control device configured to control a movement of the second spool valve, wherein the first spool valve and the second spool valve are formed in a valve block of control valves, and the second spool valve is disposed upstream of the first spool valve.

DETAILED DESCRIPTION OF THE PREFERRED EMBODIMENTS

The excavator of the related art uses a poppet type control valve, so there is a possibility that the flow rate of the hydraulic oil flowing into the arm cylinder cannot be appropriately limited. Therefore, it may not be possible to appropriately distribute hydraulic oil to a plurality of hydraulic actuators during a composite operation.

In view of the above, it is desirable to provide an excavator that can more appropriately distribute hydraulic oil to a plurality of hydraulic actuators during a composite operation.

Figure 1:
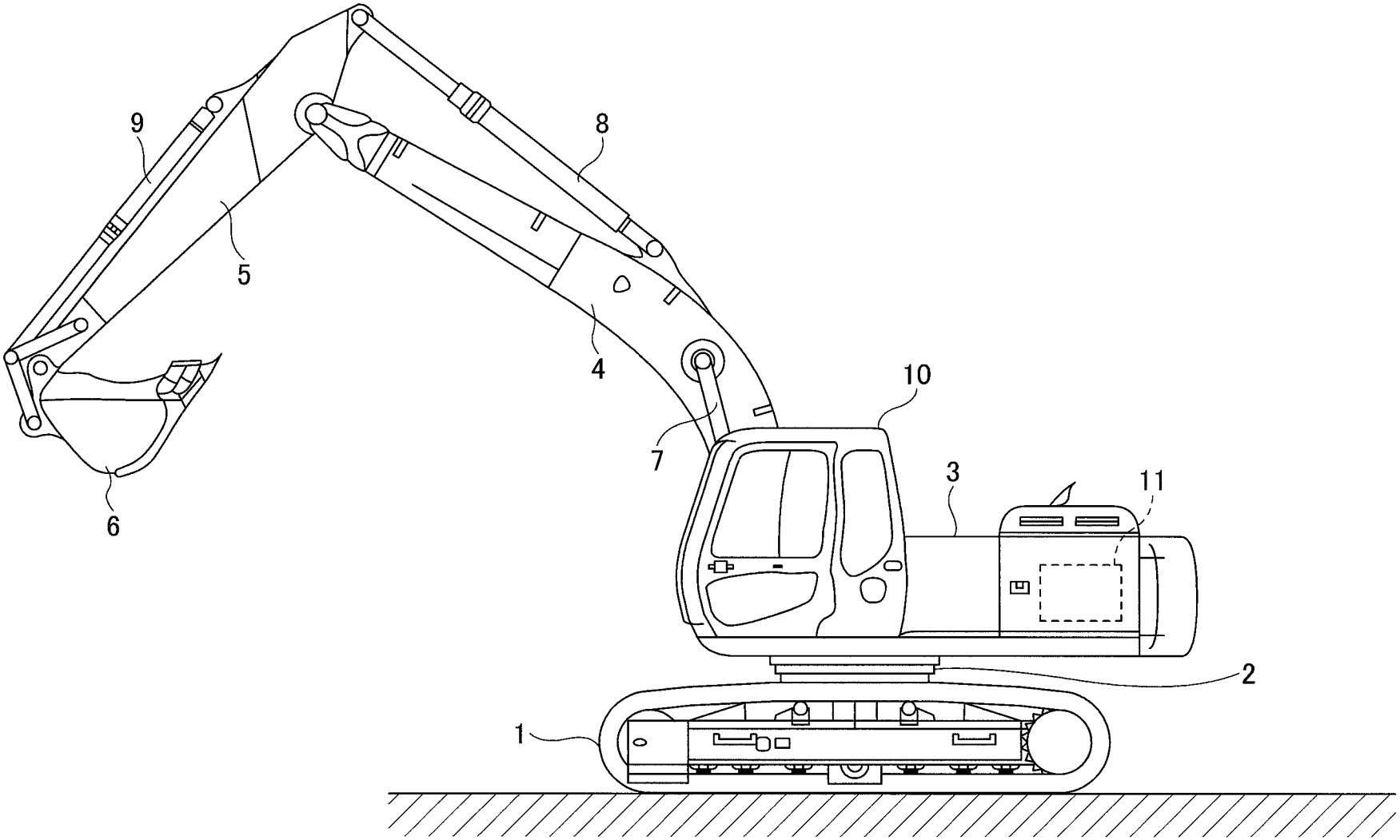
FIG. 1 is a side view of an excavator according to an embodiment of the present invention.

First, with reference to FIG. 1, an excavator that is a construction machine according to an embodiment of the present invention will be described. FIG. 1 is a side view of the excavator. An upper turning body 3 is mounted on a lower travelling body 1 of the excavator illustrated in FIG. 1, via a turning mechanism 2. A boom 4 that is a work element is attached to the upper turning body 3. An arm 5 that is a work element is attached to the tip of the boom 4, and a bucket 6 that is a work element and an end attachment is attached to the tip of the arm 5. The boom 4, the arm 5, and the bucket 6 are hydraulically driven by a boom cylinder 7, an arm cylinder 8, and a bucket cylinder 9, respectively. A cabin 10 is provided on the upper turning body 3 and a power source such as an engine 11 is mounted on the upper turning body 3.

Figure 2:
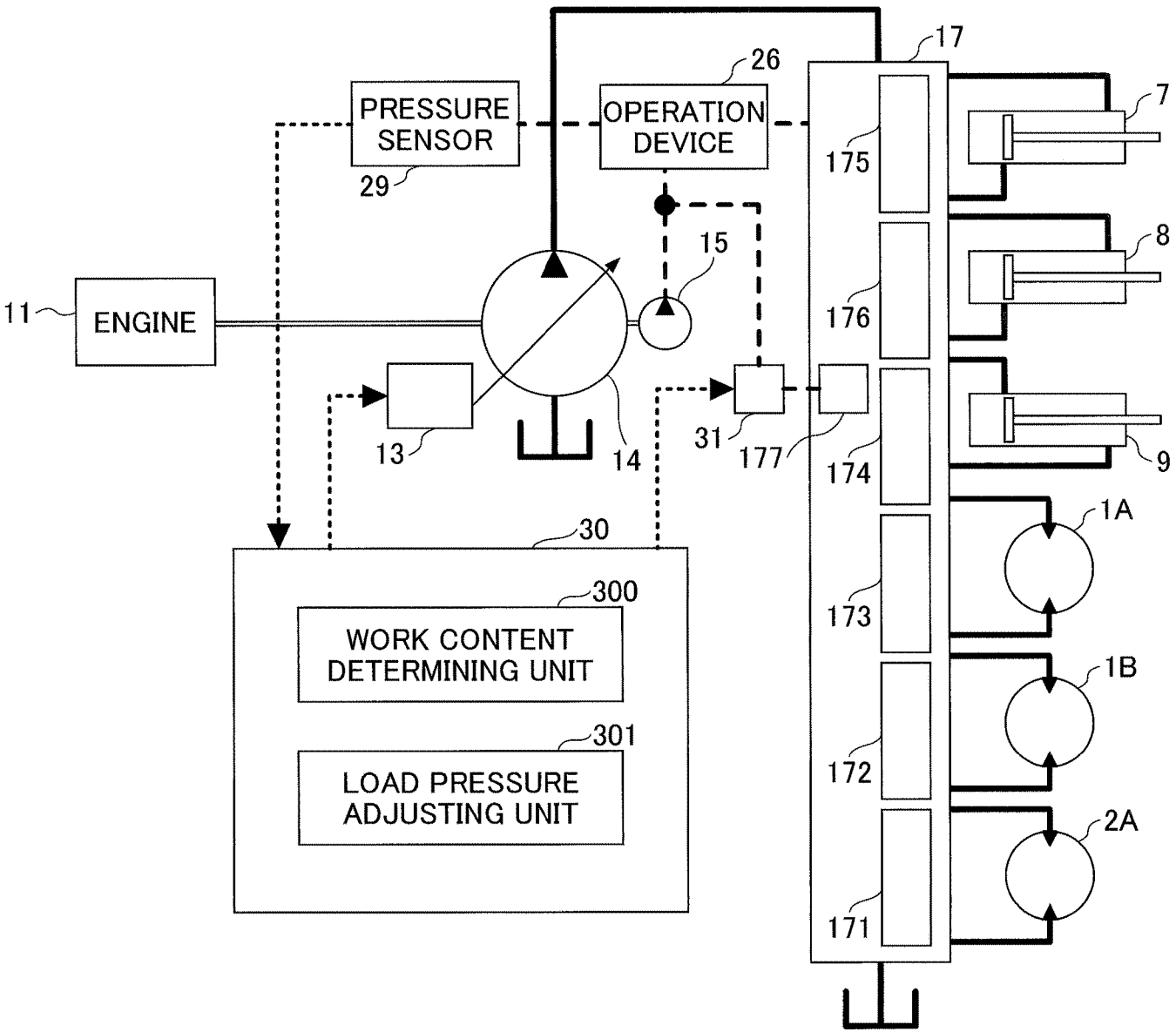
FIG. 2 is a block diagram illustrating a configuration example of a drive system of the excavator of FIG. 1.

FIG. 2 is a block diagram illustrating a configuration example of a driving system of the excavator of FIG. 1, in which a mechanical power transmission line, a hydraulic oil line, a pilot line, and an electric control line are indicated by a double line, a bold solid line, a broken line, and a dotted line, respectively.

The driving system of the excavator mainly includes the engine 11, a regulator 13, a main pump 14, a pilot pump 15, a control valve unit 17, an operation device 26, a pressure sensor 29, a controller 30, and a pressure control valve 31.

The engine 11 is a driving source of the excavator. In the present embodiment, the engine 11 is, for example, a diesel engine that is an internal combustion engine operating to maintain a predetermined rotational speed. An output shaft of the engine 11 is connected to input shafts of the main pump 14 and the pilot pump 15.

The main pump 14 supplies hydraulic oil to the control valve unit 17 via a hydraulic oil line. The main pump 14 is, for example, a swash plate type variable displacement hydraulic pump.

The regulator 13 controls the discharge amount of the main pump 14. In the present embodiment, the regulator 13 controls the discharge amount of the main pump 14, for example, by adjusting the swash plate tilt angle of the main pump 14 according to the discharge pressure of the main pump 14 and control signals from the controller 30, etc.

The pilot pump 15 supplies hydraulic oil to various hydraulic control devices including the operation device 26 and the pressure control valve 31, via the pilot line. The pilot pump 15 is, for example, a fixed displacement type hydraulic pump.

The control valve unit 17 is a hydraulic control device for controlling the hydraulic system in the excavator. Specifically, the control valve unit 17 includes control valves 171 to 176 as first spool valves and a control valve 177 as a second spool valves for controlling the flow of hydraulic oil discharged by the main pump 14. The control valve unit 17 selectively supplies the hydraulic oil discharged by the main pump 14 to one or more hydraulic actuators through the control valves 171 to 176. The control valves 171 to 176 control the flow rate of the hydraulic oil flowing from the main pump 14 to the hydraulic actuator and the flow rate of the hydraulic oil flowing from the hydraulic actuator to the hydraulic oil tank. The hydraulic actuator includes the boom cylinder 7, the arm cylinder 8, the bucket cylinder 9, a left side traveling hydraulic motor 1A, a right side traveling hydraulic motor 1B, and a turning hydraulic motor 2A. Through the control valve 177, the control valve unit 17 selectively causes the hydraulic oil, which is flowing out from the hydraulic actuator, to flow to the hydraulic oil tank. The control valve 177 controls the flow rate of the hydraulic oil flowing from the hydraulic actuator to the hydraulic oil tank.

The operation device 26 is a device used by the operator for operating the hydraulic actuator. In the present embodiment, the operation device 26 supplies the hydraulic oil discharged by the pilot pump 15 into the pilot port of the control valve corresponding to each of the hydraulic actuators, via the pilot line. The pressure (pilot pressure) of the hydraulic oil supplied to each of the pilot ports is pressure corresponding to the operation direction and the operation amount of a lever or a pedal (not illustrated) of the operation device 26 corresponding to each of the hydraulic actuators.

The pressure sensor 29 detects the operation content of the operator using the operation device 26. The pressure sensor 29 detects, for example, in the form of pressure, the operation direction and the operation amount of a lever or a pedal of the operation device 26 corresponding to each of the hydraulic actuators, and outputs the detected value to the controller 30. The operation content of the operation device 26 may be detected using a sensor other than the pressure sensor.

The controller 30 is a control device for controlling the excavator. In the present embodiment, the controller 30 is formed of a computer including, for example, a CPU, a RAM, and a ROM, etc. The controller 30 reads programs respectively corresponding to a work content determining unit 300 and a load pressure adjusting unit 301, from the ROM, loads the programs into the RAM, and causes the CPU to execute processes corresponding to the programs.

Specifically, the controller 30 executes processes by the work content determining unit 300 and the load pressure adjusting unit 301 based on outputs from various sensors. Subsequently, the controller 30 appropriately outputs control signals corresponding to the processing results of the work content determining unit 300 and the load pressure adjusting unit 301, to the regulator 13 and the pressure control valve 31, etc.

For example, the work content determining unit 300 determines whether an unbalanced composite operation is being performed based on outputs from various sensors. In the present embodiment, the work content determining unit 300 determines that a boom raising operation and an arm closing operation are being performed based on the output of the pressure sensor 29, and also determines that an unbalanced composite operation is being performed upon determining that the arm rod pressure is less than the boom bottom pressure. This is because it can be estimated that the speed of raising the boom 4 is slow and the speed of closing the arm 5 is fast. The arm rod pressure is the pressure of the rod side oil chamber of the arm cylinder 8, and is detected by the arm rod pressure sensor. The boom bottom pressure is the pressure of the bottom side oil chamber of the boom cylinder 7, and is detected by the boom bottom pressure sensor. Then, when the work content determining unit 300 determines that an unbalanced composite operation is being performed, the load pressure adjusting unit 301 outputs a control instruction to the pressure control valve 31.

The pressure control valve 31 operates according to a control instruction output from the controller 30. In the present embodiment, the pressure control valve 31 is a solenoid valve that adjusts the control pressure introduced from the pilot pump 15 into the pilot port of the control valve 177 in the control valve unit 17 according to a current instruction output from the controller 30. The controller 30 reduces the opening area of the flow path associated with the control valve 177 by operating the control valve 177 installed in a parallel pipeline supplying hydraulic oil to the arm cylinder 8, for example. With this configuration, the controller 30 can prevent most of the hydraulic oil discharged by the main pump 14 from flowing into the arm cylinder 8 having a relatively low load pressure, during a composite operation including arm closing and boom raising. The control valve 177 may be installed between the control valve 176 and the rod-side oil chamber of the arm cylinder 8.

The pressure control valve 31 may reduce the opening area of the flow path associated with the control valve installed in the parallel pipeline that supplies hydraulic oil to the bucket cylinder 9, so that most of the hydraulic oil does not flow into the bucket cylinder 9 having a relatively low load pressure, during the composite operation including opening and closing of the bucket 6. Similarly, the pressure control valve 31 may reduce the opening area of the flow path associated with the control valve installed in the parallel pipeline that supplies hydraulic oil to the boom cylinder 7, so that most of the hydraulic oil does not flow into the boom cylinder 7 having a relatively low load pressure, during the composite operation including opening and closing of the boom 4.

Figure 3:
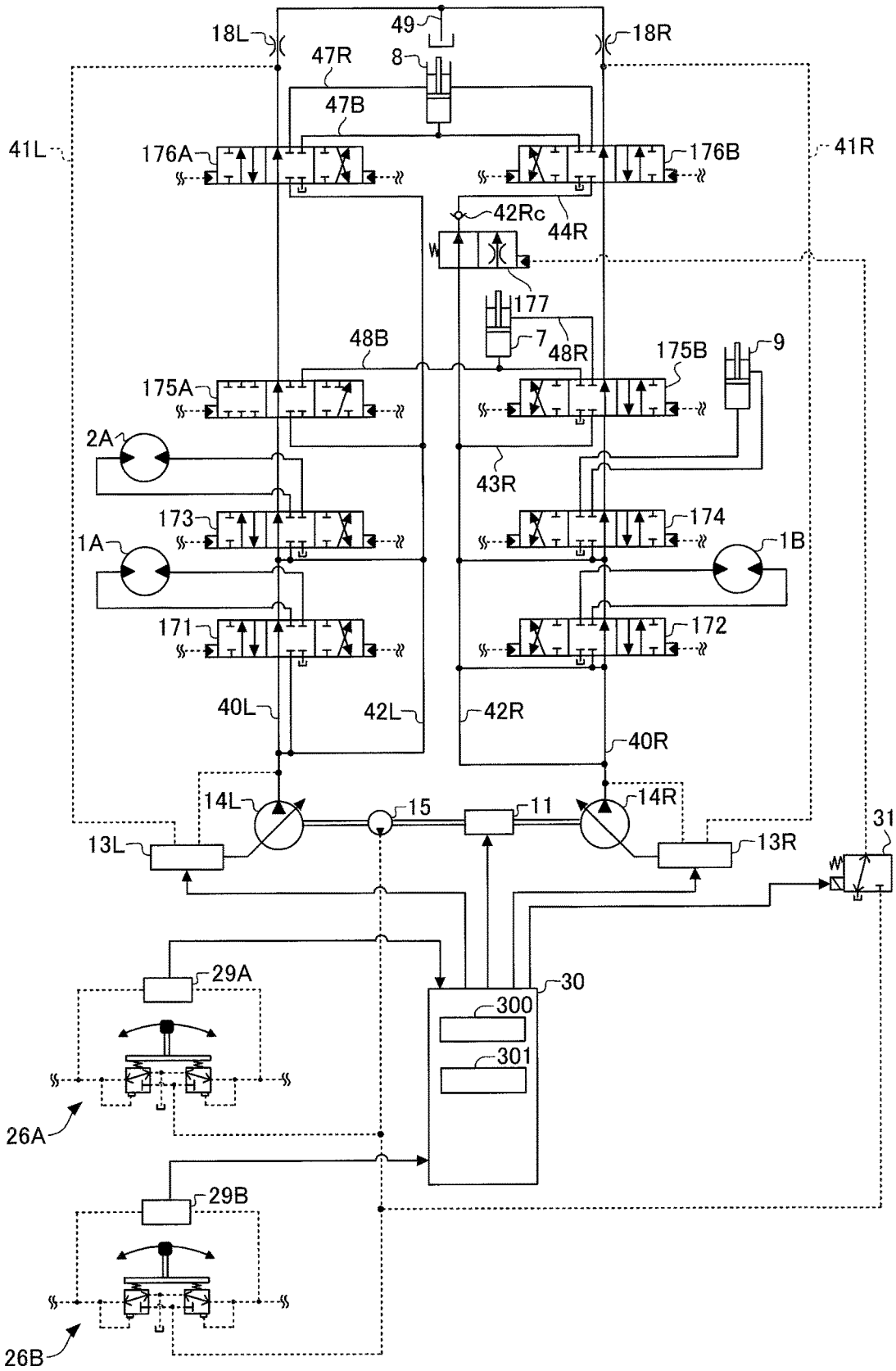
FIG. 3 is a schematic view illustrating a configuration example of a hydraulic system installed in the excavator of FIG. 1.

Next, with reference to FIG. 3, details of the hydraulic system installed in the excavator will be described. FIG. 3 is a schematic diagram illustrating a configuration example of a hydraulic system installed in the excavator of FIG. 1. In FIG. 3, similar to FIG. 2, the mechanical power transmission line, the hydraulic oil line, the pilot line, and the electric control line are indicated by a double line, a bold solid line, a broken line, and a dotted line, respectively.

In FIG. 3, the hydraulic system circulates hydraulic oil from the main pumps 14L, 14R driven by the engine 11, through center bypass pipelines 40L, 40R and parallel pipelines 42L, 42R, to the hydraulic oil tank. The main pumps 14L, 14R correspond to the main pump 14 in FIG. 2.

The center bypass pipeline 40L is a hydraulic oil line passing through the control valves 171, 173, 175A, and 176A disposed in the control valve unit 17. The center bypass pipeline 40R is a hydraulic oil line passing through the control valves 172, 174, 175B, and 176B disposed in the control valve unit 17.

The control valve 171 is a spool valve for switching the flow of the hydraulic oil, in order to supply the hydraulic oil discharged by the main pump 14L to the left side traveling hydraulic motor 1A, and also to discharge the hydraulic oil discharged by the left side traveling hydraulic motor 1A to the hydraulic oil tank.

The control valve 172 is a spool valve for switching the flow of the hydraulic oil, in order to supply the hydraulic oil discharged by the main pump 14R to the right side traveling hydraulic motor 1B, and also to discharge the hydraulic oil discharged by the right side traveling hydraulic motor 1B to the hydraulic oil tank.

The control valve 173 is a spool valve for switching the flow of the hydraulic oil, in order to supply the hydraulic oil discharged by the main pump 14L to the turning hydraulic motor 2A, and to discharge the hydraulic oil discharged by the turning hydraulic motor 2A to the hydraulic oil tank.

The control valve 174 is a spool valve for supplying the hydraulic oil discharged by the main pump 14R to the bucket cylinder 9 and to discharge the hydraulic oil in the bucket cylinder 9 to the hydraulic oil tank.

The control valves 175A, 175B are spool valves that are boom-use first spool valves for switching the flow of the hydraulic oil, in order to supply the hydraulic oil discharged by the main pumps 14L, 14R to the boom cylinder 7, and to discharge the hydraulic oil in the boom cylinder 7 to the hydraulic oil tank. In the present embodiment, the control valve 175A operates only when the boom 4 is raised, and does not operate when the boom 4 is lowered.

The control valves 176A, 176B are spool valves that are arm-use first spool valves for switching the flow of the hydraulic oil, in order to supply the hydraulic oil discharged by the main pumps 14L, 14R to the arm cylinder 8, and to discharge the hydraulic oil in the arm cylinder 8 to the hydraulic oil tank.

The control valve 177 is a spool valve that is an arm-use second spool valve that controls the flow rate of the hydraulic oil flowing to the control valve 176B through the parallel pipeline 42R. The control valve 177 has a first valve position with a maximum opening area (for example, opening degree 100%) and a second valve position with a minimum opening area (for example, opening degree 10%). The control valve 177 is movable in a stepless manner between the first valve position and the second valve position. The control valve 177 may be disposed between the control valve 176B and the arm cylinder 8.

The parallel pipeline 42L is a hydraulic oil line parallel to the center bypass pipeline 40L. The parallel pipeline 42L can supply hydraulic oil to a control valve on a further downstream side, when the flow of the hydraulic oil passing through the center bypass pipeline 40L is limited or blocked by any one of the control valves 171, 173, and 175A. The parallel pipeline 42R is a hydraulic oil line parallel to the center bypass pipeline 40R. The parallel pipeline 42R can supply hydraulic oil to a control valve on a further downstream side, when the flow of hydraulic oil passing through the center bypass pipeline 40R is limited or blocked by any one of the control valves 172, 174, and 175B.

The regulators 13L, 13R control the discharge amounts of the main pumps 14L, 14R, for example, by adjusting the swash plate tilt angles of the main pumps 14L, 14R according to the discharge pressure of the main pumps 14L, 14R. The regulators 13L, 13R correspond to the regulator 13 in FIG. 2. Specifically, for example, when the discharge pressure of the main pumps 14L, 14R become greater than or equal to a predetermined value, the regulators 13L, 13R adjust the swash plate tilt angle of the main pumps 14L, 14R to decrease the discharge amount. This is done in order to prevent the absorption horsepower of the main pump 14, represented by the product of the discharge pressure and the discharge amount, from exceeding the output horsepower of the engine 11.

An arm operation lever 26A is an example of the operation device 26, and is used for operating the arm 5. The arm operation lever 26A introduces the control pressure corresponding to the lever operation amount into the pilot ports of the control valves 176A, 176B, by using the hydraulic oil discharged by the pilot pump 15. Specifically, when the arm operation lever 26A is operated in the arm closing direction, the hydraulic oil is introduced into the right pilot port of the control valve 176A, and the hydraulic oil is introduced into the left pilot port of the control valve 176B. When the arm operation lever 26A is operated in the arm opening direction, the hydraulic oil is introduced into the left pilot port of the control valve 176A, and the hydraulic oil is introduced into the right pilot port of the control valve 176B.

A boom operation lever 26B is an example of the operation device 26 and is used for operating the boom 4. The boom operation lever 26B introduces the control pressure corresponding to the lever operation amount into the pilot ports of the control valves 175A, 175B, by using the hydraulic oil discharged by the pilot pump 15. Specifically, when the boom operation lever 26B is operated in the boom raising direction, the hydraulic oil is introduced into the right pilot port of the control valve 175A, and the hydraulic oil is introduced into the left pilot port of the control valve 175B. On the other hand, when the boom operation lever 26B is operated in the boom lowering direction, hydraulic oil is introduced only into the right pilot port of the control valve 175B, without introducing hydraulic oil into the left pilot port of the control valve 175A.

The pressure sensors 29A, 29B are examples of the pressure sensor 29, and detect, in the form of pressure, the operation contents by the operator with respect to the arm operation lever 26A and the boom operation lever 26B, and output the detected values to the controller 30. The operation content is, for example, a lever operation direction and a lever operation amount (lever operation angle), etc.

Left and right traveling levers (or pedals), a bucket operation lever, and a turning operation lever (none are illustrated), are operation devices that respectively operate the traveling of the lower travelling body 1, the opening and closing of the bucket 6, and the turning of the upper turning body 3. Similar to the case of the arm operation lever 26A, these operation devices introduce the control pressure corresponding to the lever operation amount (or the pedal operation amount) to the left or right pilot port of the control valve corresponding to each of the hydraulic actuators, by using the hydraulic oil discharged by the pilot pump 15. Similar to the case of the pressure sensor 29A, the operation contents by the operator for each of these operation devices are detected in the form of pressure by the corresponding pressure sensors, and the detection values are output to the controller 30.

The controller 30 receives the output of the pressure sensor 29A, etc., outputs a control signal to the regulators 13L, 13R as necessary, and changes the discharge amount of the main pumps 14L, 14R.

The pressure control valve 31 adjusts the control pressure introduced from the pilot pump 15 into the pilot port of the control valve 177, according to a current instruction output from the controller 30. The pressure control valve 31 is capable of adjusting the control pressure so that the control valve 177 can be stopped at any position between the first valve position and the second valve position.

Here, negative control adopted in the hydraulic system of FIG. 3 will be described.

The center bypass pipelines 40L, 40R are provided with negative control diaphragms 18L, 18R between the respective control valves 176A, 176B located at the most downstream side and the hydraulic oil tank. The flow of the hydraulic oil discharged by the main pumps 14L, 14R is limited by the negative control diaphragms 18L, 18R. Then, the negative control diaphragms 18L, 18R generate control pressure (hereinafter referred to as "negative control pressure") for controlling the regulators 13L, 13R.

Negative pressure pipeline lines 41L, 41R indicated by broken lines are pilot lines for transmitting the negative control pressure generated upstream of the negative control diaphragms 18L, 18R to the regulators 13L, 13R.

The regulators 13L, 13R control the discharge amounts of the main pumps 14L, 14R by adjusting the swash plate tilt angle of the main pumps 14L, 14R according to the negative control pressure. In the present embodiment, the regulators 13L, 13R decrease the discharge amounts of the main pumps 14L, 14R as the introduced negative control pressure increases, and increase the discharge amounts of the main pumps 14L, 14R as the introduced negative control pressure decreases.

Specifically, as illustrated in FIG. 3, when none of the hydraulic actuators in the excavator are operated (hereinafter referred to as a "standby mode"), the hydraulic oil discharged by the main pumps 14L, 14R passes through the center bypass pipelines 40L, 40R and reaches the negative control diaphragms 18L, 18R. Then, the flow of the hydraulic oil discharged by the main pumps 14L, 14R increases the negative control pressure generated upstream of the negative control diaphragms 18L, 18R. As a result, the regulators 13L, 13R decrease the discharge amounts of the main pumps 14L, 14R to the allowable minimum discharge amount, and suppress the pressure loss (pumping loss) when the discharged hydraulic oil passes through the center bypass pipelines 40L, 40R.

On the other hand, when any of the hydraulic actuators is operated, the hydraulic oil discharged by the main pumps 14L, 14R flows into the operated hydraulic actuator via the control valve corresponding to the operated hydraulic actuator. Then, the flow of the hydraulic oil discharged by the main pumps 14L, 14R reduces or eliminates the amount reaching the negative control diaphragms 18L, 18R, and lowers the negative control pressure generated upstream of the negative control diaphragms 18L, 18R. As a result, the regulators 13L, 13R receiving the reduced negative control pressure increase the discharge amounts of the main pumps 14L, 14R, and circulate a sufficient amount of hydraulic oil to the operated hydraulic actuator, to reliably drive the operated hydraulic actuator.

With the above configuration, in the hydraulic system of FIG. 3, it is possible to suppress wasteful energy consumption in the main pumps 14L, 14R in the standby mode. Wasteful energy consumption includes pumping loss in the center bypass pipelines 40L, 40R caused by the hydraulic oil discharged by the main pumps 14L, 14R.

In the hydraulic system of FIG. 3, when operating the hydraulic actuator, it is possible to reliably supply a necessary and sufficient amount of hydraulic oil from the main pumps 14L, 14R to the operated hydraulic actuator.

Figure 4:
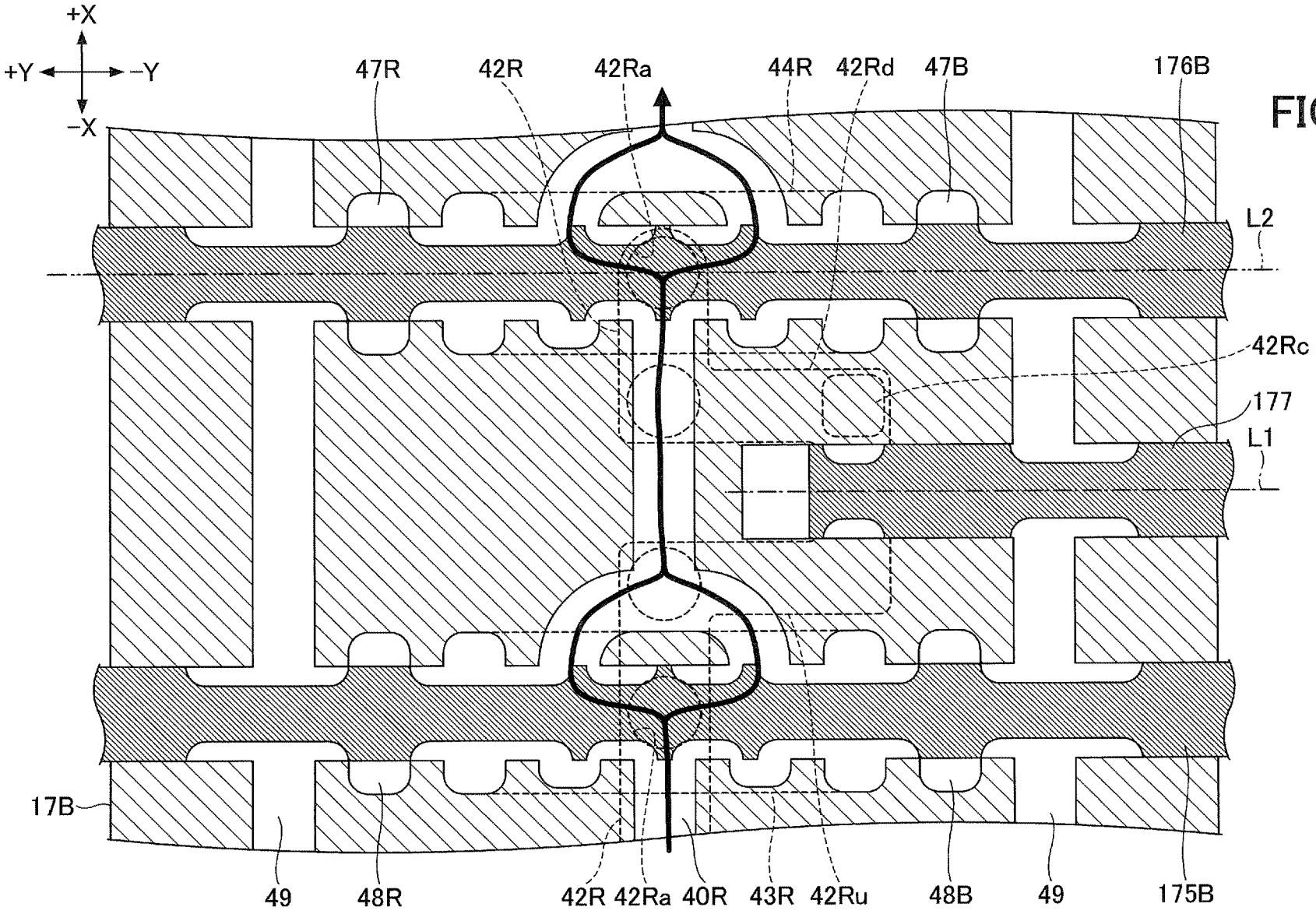
FIG. 4 is a partial cross-sectional view of a control valve.
Figure 5:
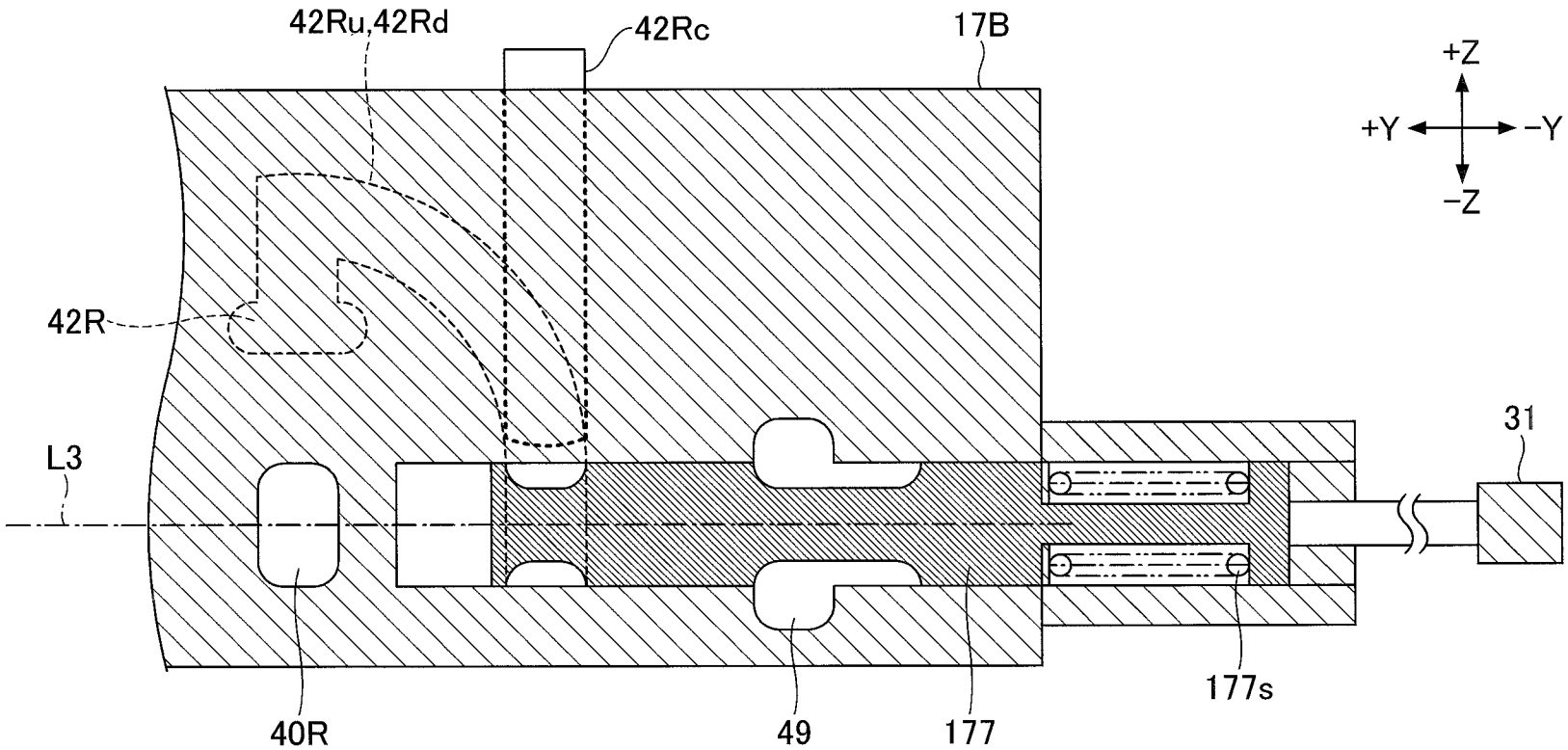
FIG. 5 is a partial cross-sectional view of a second spool valve.
Figure 6:
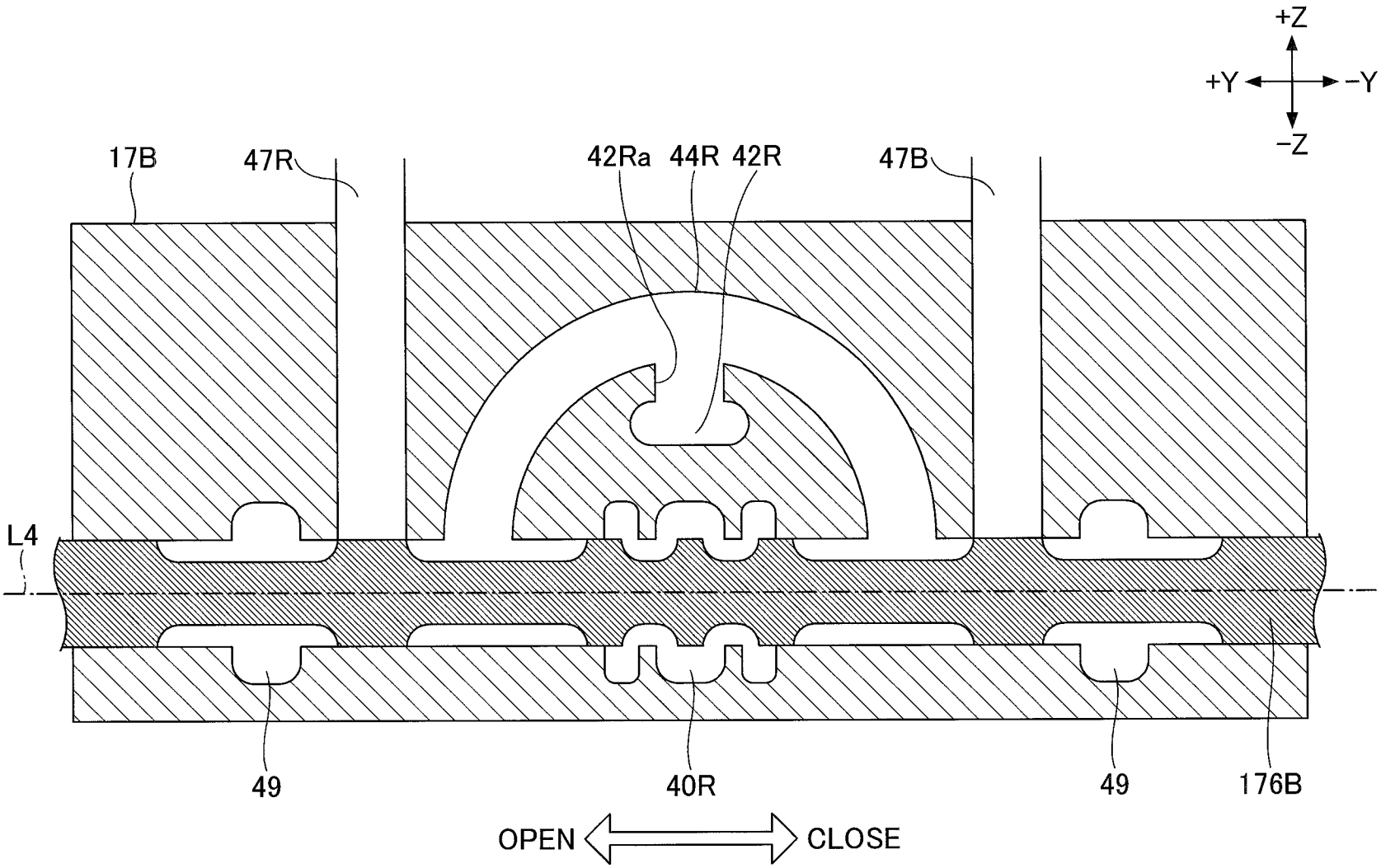
FIG. 6 is a partial cross-sectional view of an arm-use first spool valve.

Next, with reference to FIGS. 4 to 6, the configuration of the control valve 177 will be described. FIG. 4 is a partial cross-sectional of the control valve unit 17. FIG. 5 is a partial cross-sectional view of the control valve 177 as viewed from the −X side of a plane including a line segment L1 indicated by a one-dot chain line in FIG. 4. FIG. 6 is a partial cross-sectional view of the control valve 176B as viewed from the −X side of a plane including a line segment L2 indicated by a two-dot chain line in FIG. 4. FIG. 4 corresponds to a partial cross-sectional view as viewed from the +Z side of a plane including a line segment L3 indicated by a one-dot chain line in FIG. 5 and a line segment L4 indicated by a one-dot chain line in FIG. 6. The bold solid arrows in FIG. 4 indicate the flow of hydraulic oil in the center bypass pipeline 40R.

In the present embodiment, the control valve 175B, the control valve 176B, and the control valve 177 are formed in a valve block 17B of the control valve unit 17. The control valve 177 is disposed between the control valve 175B and the control valve 176B. That is, the control valve 177 is disposed on the +X side of the control valve 175B and on the −X side of the control valve 176B.

As illustrated in FIG. 4, the center bypass pipeline 40R branches into two right and left pipelines on the downstream side of the spool of the control valve 175B, and then joins together as one pipeline. Then, the center bypass pipeline 40R leads to the next control valve 176B in the state of one pipeline. When the arm operation lever 26A and the boom operation lever 26B are both in a neutral state, the hydraulic oil flowing through the center bypass pipeline 40R crosses the spool of each control valve and flows to the downstream side of the spool of each control valve, as indicated by the thick solid lines in FIG. 4.

As illustrated in FIG. 5, the control valve 177 is disposed on the −Y side of the center bypass pipeline 40R. FIG. 5 illustrates that the control valve 177 is at the first valve position with an opening degree of 100%. At the first valve position, the control valve 177 maximizes the opening area of the flow path connecting a bridge pipeline 42Ru and a bridge pipeline 42Rd, and creates a state in which hydraulic oil can flow most easily. Then, when a spring 177*s* contracts according to the rise of the control pressure generated by the pressure control valve 31, the control valve 177 moves to the +Y side to reduce the opening area of the flow path connecting the bridge pipeline 42Ru and the bridge pipeline 42Rd, to make it difficult for the hydraulic oil to flow. The bridge pipeline 42Ru and the bridge pipeline 42Rd are part of the parallel pipeline 42R. A poppet type check valve 42Rc is disposed in the bridge pipeline 42Rd downstream of the control valve 177. The poppet type check valve 42Rc prevents backflow of hydraulic oil from the bridge pipeline 42Ru toward the bridge pipeline 42Rd.

As indicated by the bidirectional arrow in FIG. 6, the spool of the control valve 176B moves to the −Y side when the arm operation lever 26A is operated in the closing direction, and moves to the +Y side when the arm operation lever 26A is operated in the opening direction. The control valve 176B is structured such that the parallel pipeline 42R can selectively communicate with either an arm bottom pipeline 47B or an arm rod pipeline 47R via an arm-use bridge pipeline 44R. In the present embodiment, the cross-sectional shape (see FIG. 6) of the arm-use bridge pipeline 44R is formed so as to include the cross-sectional shapes of the bridge pipeline 42Ru and the bridge pipeline 42Rd, and the positions (heights) of these pipelines are equal to each other in the Z axis direction. Specifically, when the spool moves in the −Y direction, the center bypass pipeline 40R is blocked. Then, the arm-use bridge pipeline 44R and the arm bottom pipeline 47B communicate with each other, and the arm rod pipeline 47R and a return oil pipeline 49 communicate with each other, by grooves formed in the spool. Then, the hydraulic oil flowing through the parallel pipeline 42R flows into the bottom side oil chamber of the arm cylinder 8 through a connection pipeline 42Ra, the arm-use bridge pipeline 44R, and the arm bottom pipeline 47B. Furthermore, the hydraulic oil flowing out from the rod side oil chamber of the arm cylinder 8 is discharged to the hydraulic oil tank through the arm rod pipeline 47R and the return oil pipeline 49. As a result, the arm cylinder 8 expands and the arm 5 is closed. Alternatively, when the spool moves in the +Y direction, the center bypass pipeline 40R is blocked. Then, the arm-use bridge pipeline 44R and the arm rod pipeline 47R are communicated with each other, and the arm bottom pipeline 47B and the return oil pipeline 49 are communicated with each other, by grooves formed in the spool. Then, the hydraulic oil flowing through the parallel pipeline 42R flows into the rod side oil chamber of the arm cylinder 8 through the connection pipeline 42Ra, the arm-use bridge pipeline 44R, and the arm rod pipeline 47R. The hydraulic oil flowing out from the bottom side oil chamber of the arm cylinder 8 is discharged to the hydraulic oil tank through the arm bottom pipeline 47B and the return oil pipeline 49. As a result, the arm cylinder 8 is contracted and the arm 5 is opened.

Figure 7:
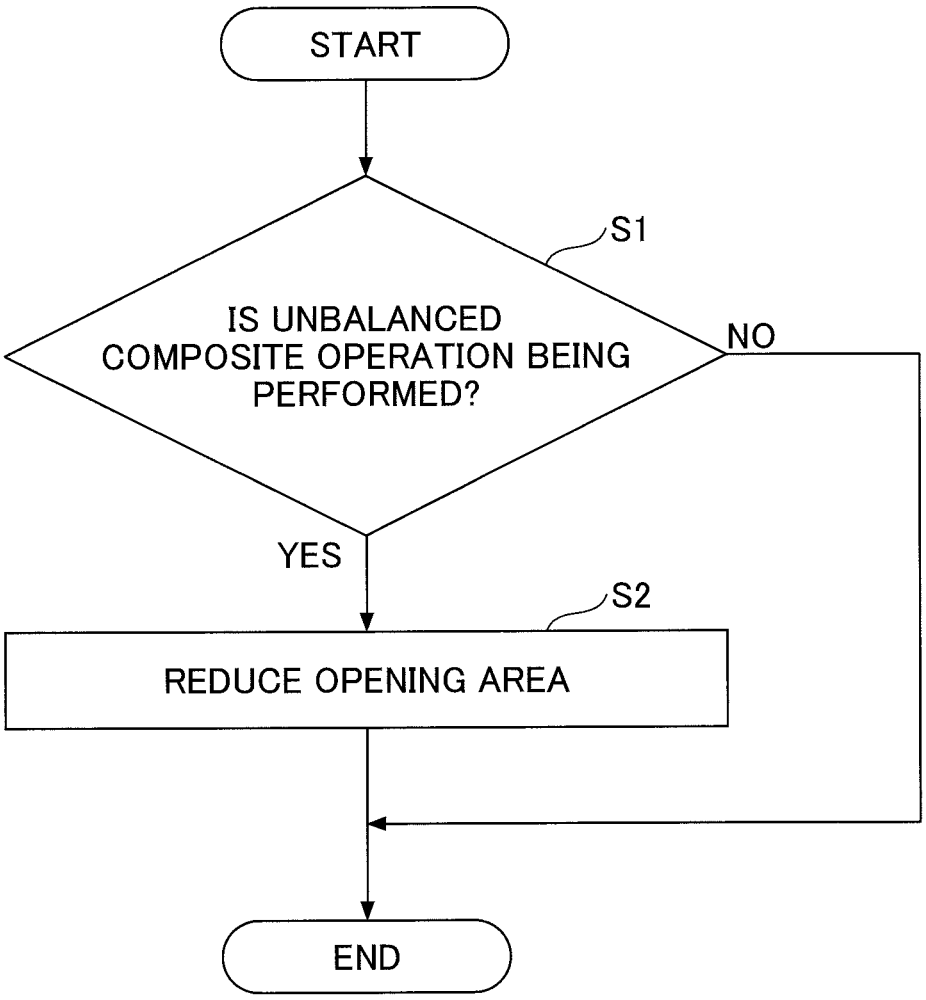
FIG. 7 is a flowchart illustrating a flow of an example of a load pressure adjustment process.
Figure 8:
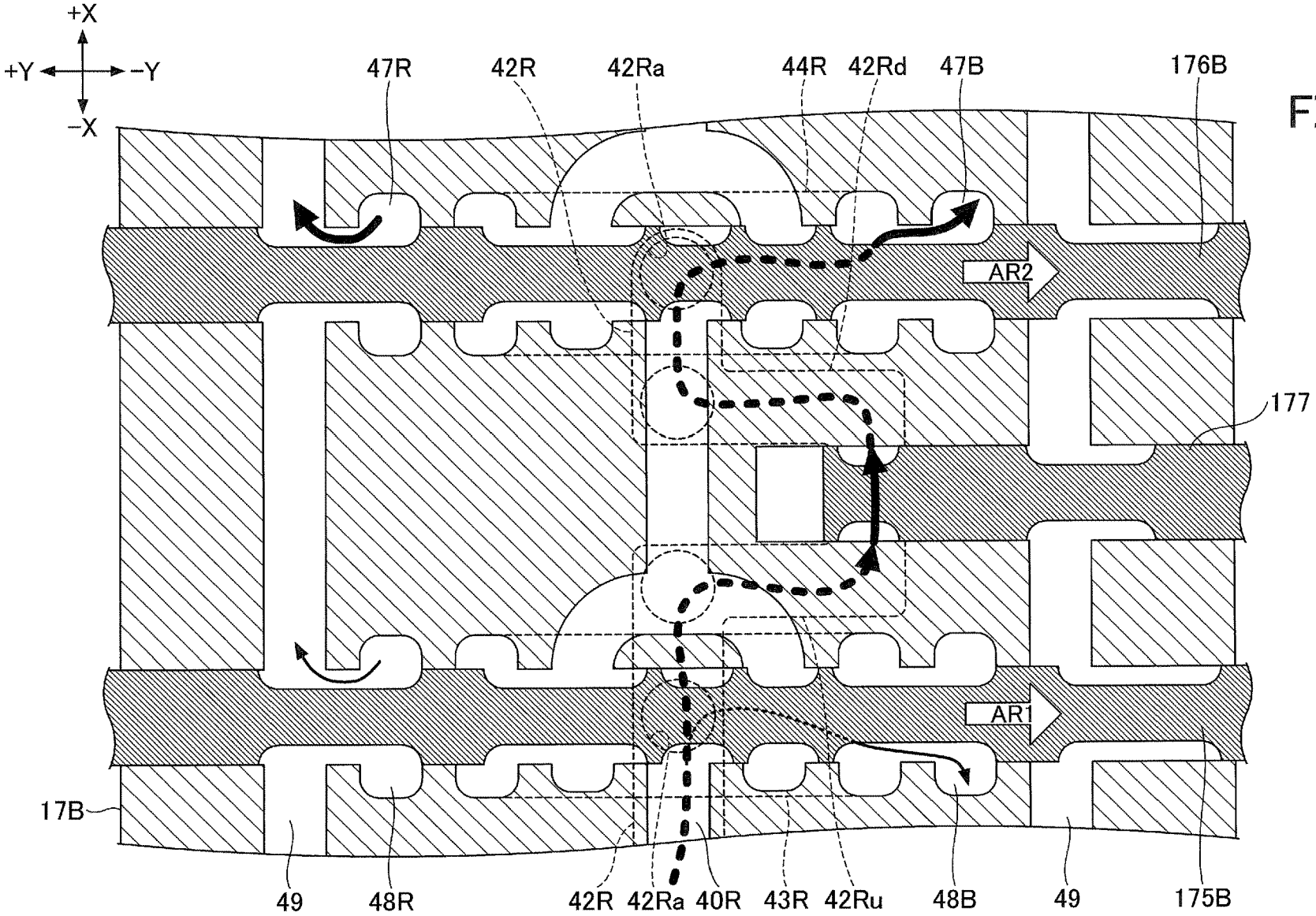
FIG. 8 is a partial cross-sectional view of a control valve illustrating a state before load pressure adjustment.
Figure 9:
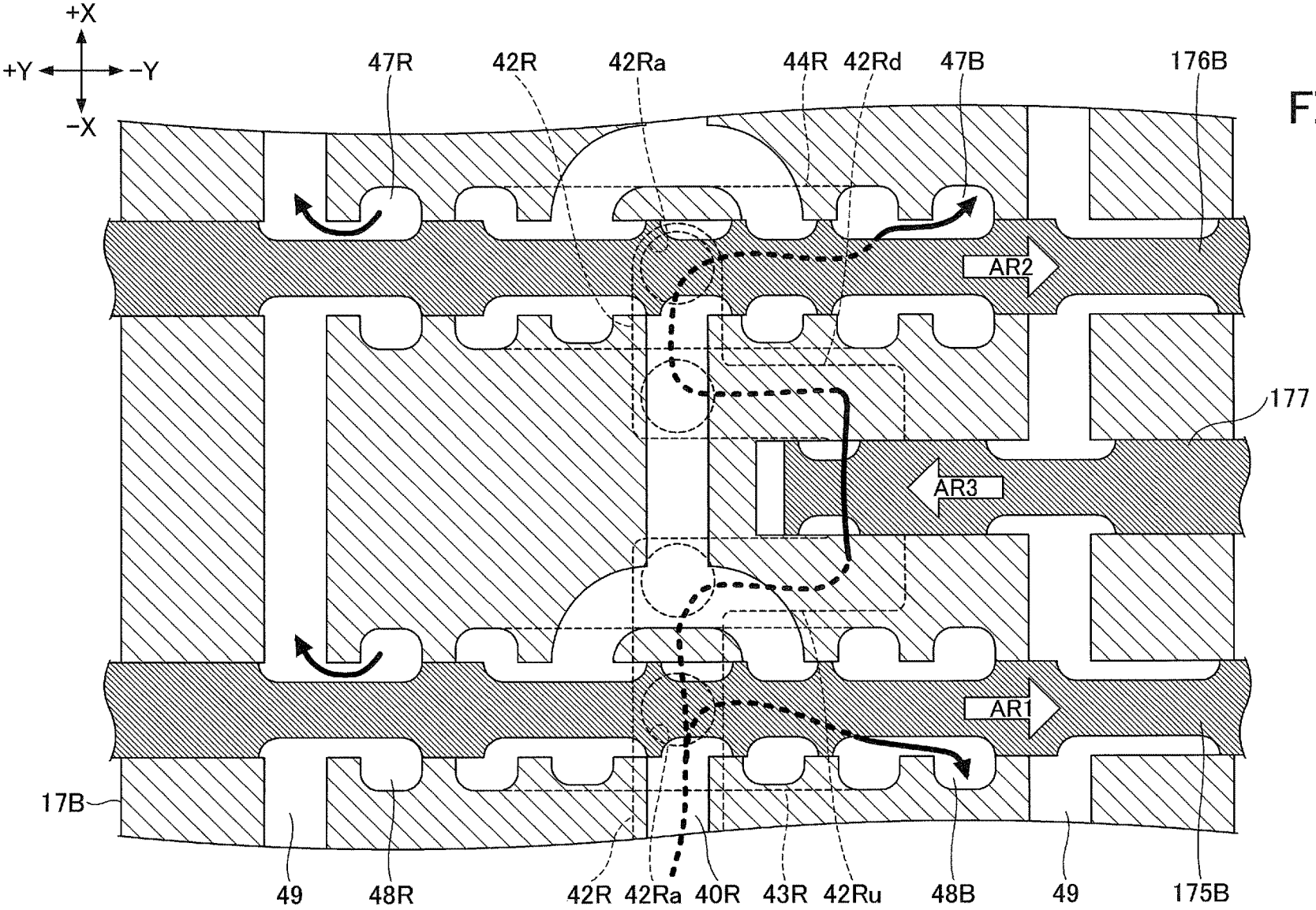
FIG. 9 is a partial cross-sectional view of a control valve illustrating a state after load pressure adjustment.

Next, with reference to FIGS. 7 to 9, a process in which the controller 30 reduces the opening area of the flow path associated with the control valve 177 to adjust the imbalance of the load pressure (hereinafter referred to as a "load pressure adjustment process") will be described. FIG. 7 is a flowchart illustrating the flow of the load pressure adjustment process. During the composite operation of boom raising and arm closing, the controller 30 repeatedly executes this load pressure adjustment process at a predetermined control cycle. FIGS. 8 and 9 correspond to FIG. 4 and illustrate the state of the control valve unit 17 when the arm operation lever 26A and the boom operation lever 26B are operated. FIG. 8 illustrates the state when the load pressure adjustment process is not being executed, and FIG. 9 illustrates the state when the load pressure adjustment process is being executed.

When the boom operation lever 26B is operated in the boom raising direction, the control valve 175B moves in the −Y direction as indicated by an arrow AR1 in FIG. 8 and FIG. 9, to block the center bypass pipeline 40R. As a result, the hydraulic oil in the center bypass pipeline 40R is blocked by the spool of the control valve 175B and does not flow to the downstream side thereof. Furthermore, a boom-use bridge pipeline 43R and a boom bottom pipeline 48B communicate with each other, and a boom rod pipeline 48R and the return oil pipeline 49 communicate with each other, by grooves formed in the spool of the control valve 175B. Then, the hydraulic oil flowing through the parallel pipeline 42R flows into the bottom side oil chamber of the boom cylinder 7 through the connection pipeline 42Ra, the boom-use bridge pipeline 43R, and the boom bottom pipeline 48B. Furthermore, hydraulic oil flowing out from the rod side oil chamber of the boom cylinder 7 passes through the boom rod pipeline 48R and the return oil pipeline 49 and is discharged to the hydraulic oil tank. As a result, the boom cylinder 7 is extended and the boom 4 is raised. In FIGS. 8 and 9, the hydraulic oil flowing through the parallel pipeline 42R and the boom-use bridge pipeline 43R is indicated by thin dotted arrows. Furthermore, the hydraulic oil flowing from the boom-use bridge pipeline 43R to the boom bottom pipeline 48B and the hydraulic oil flowing from the boom rod pipeline 48R to the return oil pipeline 49 are indicated by thin solid arrows. The thickness of the arrow indicates the flow rate of the hydraulic oil, and the thicker the arrow, the higher the flow rate.

When the arm operation lever 26A is operated in the arm closing direction, the control valve 176B moves in the −Y direction as indicated by an arrow AR2 in FIG. 8 and FIG. 9 to block the center bypass pipeline 40R. As a result, the hydraulic oil in the center bypass pipeline 40R is blocked by the spool of the control valve 176B and does not flow to the downstream side thereof. Furthermore, the arm-use bridge pipeline 44R and the arm bottom pipeline 47B communicate with each other, and the arm rod pipeline 47R and the return oil pipeline 49 communicate with each other, by grooves formed in the spool of the control valve 176B. Then, the hydraulic oil flowing through the parallel pipeline 42R flows into the bottom side oil chamber of the arm cylinder 8 through the connection pipeline 42Ra, the arm-use bridge pipeline 44R, and the arm bottom pipeline 47B. Furthermore, the hydraulic oil flowing out from the rod side oil chamber of the arm cylinder 8 passes through the arm rod pipeline 47R and the return oil pipeline 49 and is discharged to the hydraulic oil tank. As a result, the arm cylinder 8 expands and the arm 5 is closed. In FIGS. 8 and 9, the hydraulic oil flowing through the parallel pipeline 42R and the arm-use bridge pipeline 44R is indicated by thick dotted arrows. Furthermore, the hydraulic oil passing through the control valve 177, the hydraulic oil flowing from the arm-use bridge pipeline 44R to the arm bottom pipeline 47B, and the hydraulic oil flowing from the arm rod pipeline 47R to the return oil pipeline 49 are indicated by thick solid arrows.

In the load pressure adjustment process, as illustrated in FIG. 7, the work content determining unit 300 of the controller 30 determines whether an unbalanced composite operation is being performed (step S1). For example, when the arm rod pressure is less than the boom bottom pressure, it is determined that an unbalanced composite operation is being performed.

When the work content determining unit 300 determines that an unbalanced composite operation is being performed (YES in step S1), the load pressure adjusting unit 301 of the controller 30 reduces the opening area of the flow path connecting the bridge pipeline 42Ru and the bridge pipeline 42Rd (step S2). In the present embodiment, the load pressure adjusting unit 301 raises the control pressure generated by the pressure control valve 31 by outputting a current instruction to the pressure control valve 31. The control valve 177 moves to the +Y side in accordance with the rise of the control pressure as indicated by an arrow AR3 in FIG. 9 to reduce the opening area of the flow path connecting the bridge pipeline 42Ru and the bridge pipeline 42Rd. As a result, the flow rate of the hydraulic oil flowing from the bridge pipeline 42Ru through the control valve 177 to the bridge pipeline 42Rd is limited, and the pressure of the hydraulic oil in the bridge pipeline 42Ru rises to the same level as the boom bottom pressure. With this configuration, the controller 30 can prevent most of the hydraulic oil discharged by the main pump 14 from flowing into the arm cylinder 8 having relatively low load pressure. That is, it is possible to prevent an unbalanced composite operation, in which the speed of raising the boom 4 is slow and the speed of closing the arm 5 is fast, from being performed.

When the work content determining unit 300 determines that an unbalanced composite operation is not being performed (NO in step S1), the load pressure adjusting unit 301 does not reduce the opening area of the flow path connecting the bridge pipeline 42Ru and the bridge pipeline 42Rd.

Note that when it is determined that the boom raising operation and the arm closing operation are being performed and that the arm rod pressure is greater than or equal to the boom bottom pressure, the work content determining unit 300 may determine that an unbalanced composite operation is being performed. This is because it can be estimated that the speed of raising the boom 4 is fast and the speed of the closing the arm 5 is slow. In this case, the load pressure adjusting unit 301 lowers the control pressure generated by the pressure control valve 31 as long as the opening area of the flow path associated with the control valve 177 has already been reduced. The control valve 177 moves to the −Y side in accordance with a decrease in the control pressure to increase the opening area of the flow path connecting the bridge pipeline 42Ru and the bridge pipeline 42Rd. As a result, the flow rate of the hydraulic oil flowing from the bridge pipeline 42Ru through the control valve 177 to the bridge pipeline 42Rd increases, and the pressure of the hydraulic oil in the bridge pipeline 42Ru decreases to the same level as the boom bottom pressure. With this configuration, the controller 30 can prevent most of the hydraulic oil discharged by the main pump 14 from flowing into the boom cylinder 7 having relatively low load pressure. That is, it is possible to prevent an unbalanced composite operation, in which the speed of raising the boom 4 is fast and the speed of closing the arm 5 is slow.

In the embodiment described above, the controller 30 increases or decreases the opening area of the flow path associated with the control valve 177 when it is determined that an unbalanced combined operation of the boom 4 and the arm 5 is being performed, so that the continuation of the unbalanced composite operation is suppressed or prevented. This process may be executed to suppress or prevent the continuation of other unbalanced composite operations such as an unbalanced composite operation of the boom 4 and the bucket 6, and an unbalanced composite operation of the arm 5 and the bucket 6.

Although preferred embodiments of the present invention have been described in detail above, the present invention is not limited to the above-described embodiments. Various modifications and substitutions may be applied to the above-mentioned embodiments without departing from the scope of the present invention.

For example, in the above-described embodiment, the control valve 177 is incorporated in the valve block 17B of the control valve unit 17. Therefore, it is unnecessary to attach the control valve 177 to the outside of the valve block 17B, and it is possible to realize a low-cost and compact hydraulic system including the control valve 177. However, the present invention does not exclude a configuration in which the control valve 177 is attached to the outside of the valve block 17B. That is, the control valve 177 may be disposed outside the valve block 17B.

Furthermore, in the above-described embodiment, a configuration is adopted in which the first spool valve corresponding to each hydraulic actuator individually executes the bleed-off control; however, it is also possible to adopt a configuration in which the bleed-off control is executed in a unified manner for a plurality of hydraulic actuators by using a unified bleed-off valve provided between the center bypass pipeline and the hydraulic oil tank. In this case, even when each first spool valve moves from the neutral position, the flow path area of the center bypass pipeline is prevented from decreasing, that is, each first spool valve does not block the center bypass pipeline. Even when this unified bleed-off valve is used, when applying the present invention, a parallel pipeline is formed separately from the center bypass pipeline.

Figure 10:
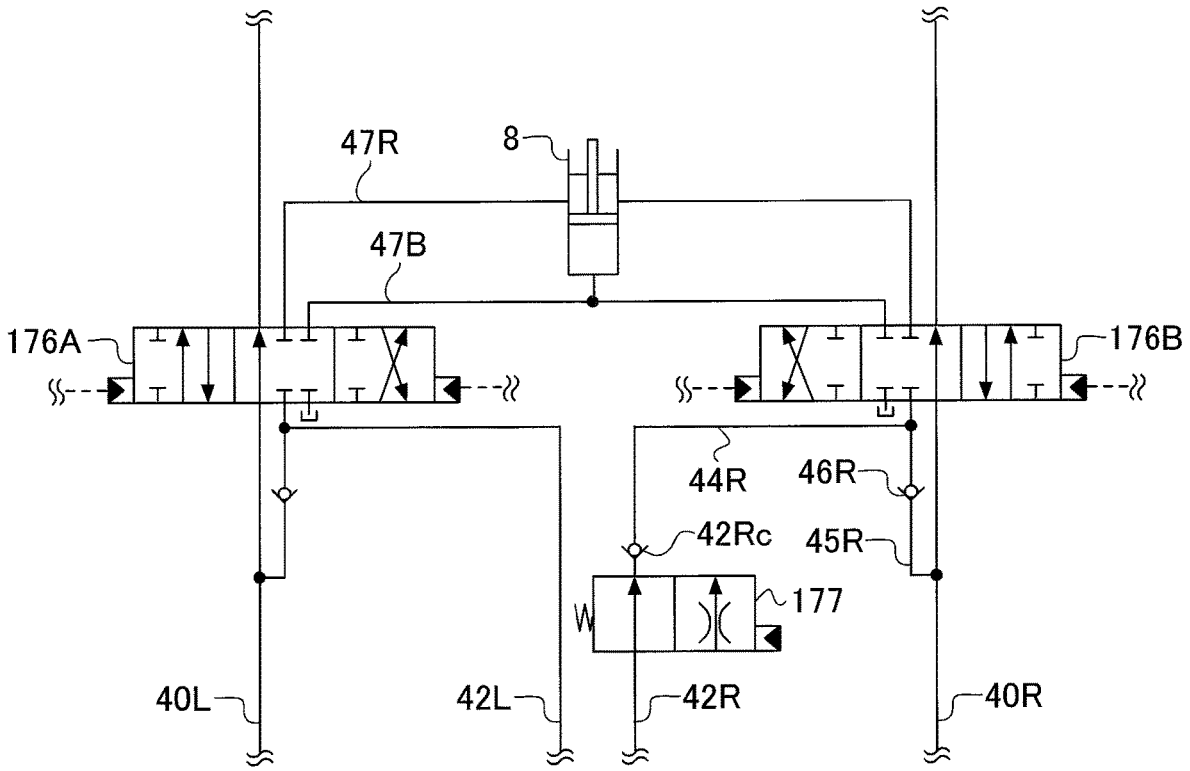
FIG. 10 is a schematic diagram illustrating another configuration example of the hydraulic system installed in the excavator of FIG. 1.

Furthermore, in the above-described embodiment, as illustrated in FIG. 3, the arm-use bridge pipeline 44R and the center bypass pipeline 40R are disconnected from each other. However, as illustrated in FIG. 10, the arm-use bridge pipeline 44R and the center bypass pipeline 40R may be connected via a connection pipeline 45R. In this case, a variable check valve 46R capable of adjusting the valve opening pressure is provided in the connection pipeline 45R between the arm-use bridge pipeline 44R and the center bypass pipeline 40R. When the opening area of the flow path associated with the control valve 177 is reduced, the variable check valve 46R does not only block the flow of the hydraulic oil from the arm-use bridge pipeline 44R to the center bypass pipeline 40R, but also blocks the flow of the hydraulic oil from the center bypass pipeline 40R to the arm-use bridge pipeline 44R.

Figure 11:
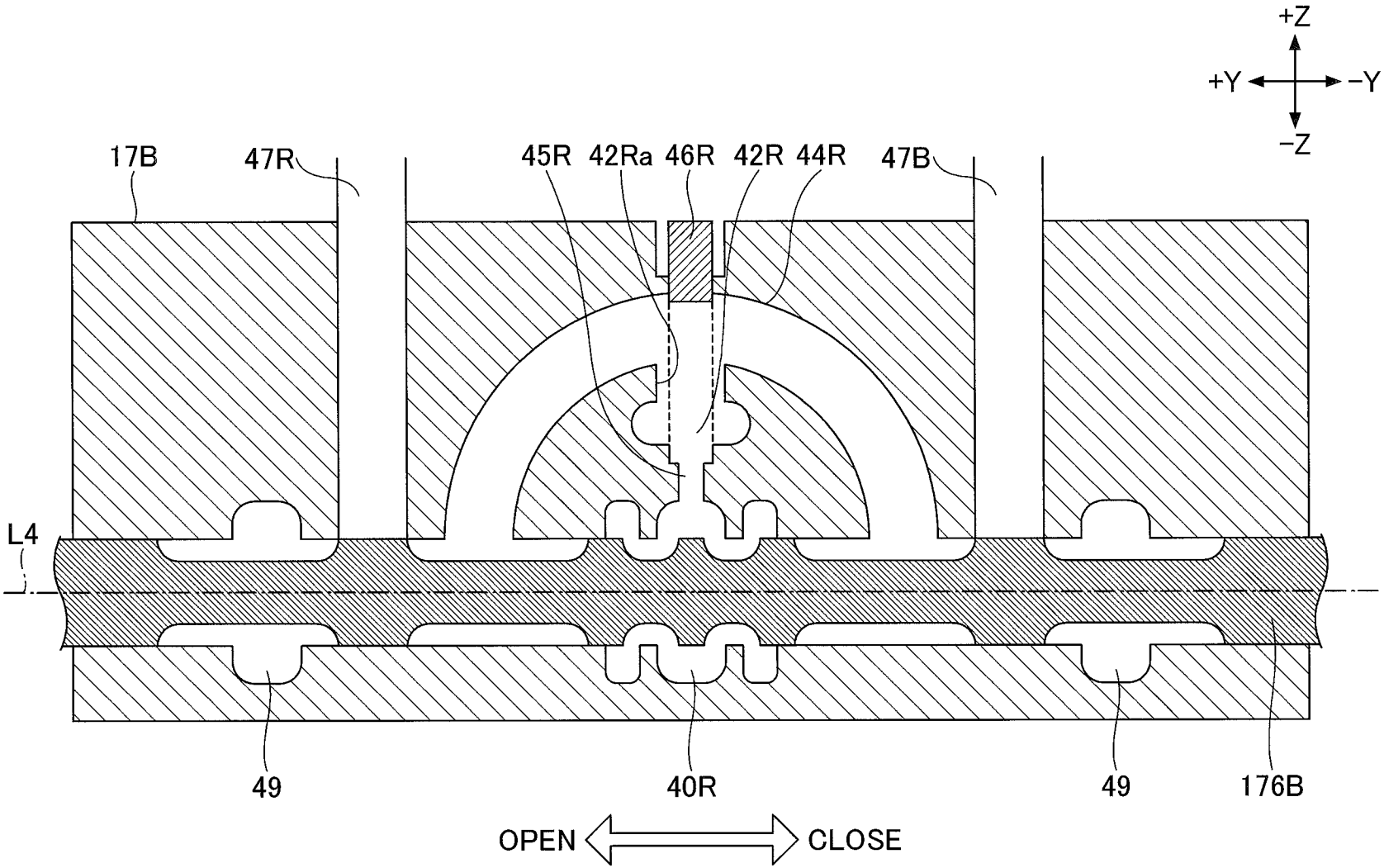
FIG. 11 is a partial cross-sectional view of an arm-use first spool valve.

FIG. 11 is a partial cross-sectional view of the control valve 176B when the arm-use bridge pipeline 44R and the center bypass pipeline 40R are connected via the connection pipeline 45R, and corresponds to FIG. 6. The broken line in FIG. 11 indicates the movement path of the variable check valve 46R. The connection pipeline 45R connecting the center bypass pipeline 40R and the parallel pipeline 42R, is switched between a communicating state and a non-communicating state, by the variable check valve 46R. In the case of a sole operation of the arm 5, other hydraulic actuators such as the boom cylinder 7 other than the arm cylinder 8 are in a non-operation state, and operation levers other than the arm operation lever 26A are in a neutral state. Therefore, at the control valves 172, 174, and 175B disposed on the upstream side of the control valve 176B, the center bypass pipeline 40R is maintained in a communicating state. Accordingly, the hydraulic oil discharged by the main pump 14R passes through the center bypass pipeline 40R toward the control valve 176B. At this time, by opening the variable check valve 46R as illustrated in FIG. 11, the controller 30 can allow the hydraulic oil of the center bypass pipeline 40R to flow into the arm cylinder 8 through the connection pipeline 45R. That is, the hydraulic oil passing through the control valve 177 and the hydraulic oil passing through the center bypass pipeline 40R and the connection pipeline 45R can be supplied together to the arm cylinder 8.

In the case of a composite operation of the boom 4 and the arm 5, the controller 30 reduces the opening area of the flow path associated with the control valve 177, and increases the pipeline resistance of the parallel pipeline 42R. Furthermore, the variable check valve 46R blocks the connection pipeline 45R. Therefore, the flow of the hydraulic oil flowing into the arm cylinder 8 can be suppressed.

According to an embodiment of the present invention, an excavator that can more appropriately distribute hydraulic oil to a plurality of hydraulic actuators during a composite operation, can be provided.

It should be understood that the invention is not limited to the above-described embodiment, but may be modified into various forms on the basis of the spirit of the invention. Additionally, the modifications are included in the scope of the invention.

What is claimed is:

1. An excavator comprising:

a lower travelling body;

an upper turning body mounted on the lower travelling body;

an engine installed in the upper turning body;

a hydraulic pump connected to the engine;

a hydraulic actuator driven by hydraulic oil discharged by the hydraulic pump to move a work element;

a control valve including a valve block, a first spool valve disposed in a center bypass pipeline, the first spool valve being configured to control a first flow rate of the hydraulic oil flowing from the hydraulic pump to the hydraulic actuator by controlling communication and blockage between the bridge pipeline and a pipeline to the hydraulic actuator, the hydraulic oil flowing from the hydraulic pump to the hydraulic actuator via a bridge pipeline, of which at, least one portion of the bridge pipeline is formed in a plane that is orthogonal to a plane in which the center bypass pipeline extends;

a second spool valve disposed in a parallel pipeline that is parallel to the center bypass pipeline, the second spool valve being configured to control a second flow rate of the hydraulic oil flowing from the hydraulic pump to the hydraulic actuator; and a control device configured to control a movement of the second spool valve, wherein the first spool valve and the second spool valve are disposed in the valve block, the center bypass pipeline, the bridge pipeline, and the parallel pipeline are formed in the valve block of the control valve, the pipeline to the hydraulic actuator and at least one portion of the bridge pipeline are formed in a plane that is orthogonal to a plane in which the center bypass pipeline and the parallel pipeline extend, the second spool valve is disposed upstream of the first spool valve for which the first flow rate is limited by the second spool valve, and an opening area of the second spool valve is adjusted by the movement of a second spool, the hydraulic oil from the second spool valve is supplied to the first spool valve via the bridge pipeline, the second spool of the second spool valve is shorter than a first spool of the first spool valve, and control pressure is applied to a pilot pressure port formed at one end of the second spool valve to control the second flow rate of the hydraulic oil, and the first spool and the second spool are disposed such that the axis lines thereof are parallel to each other.

2. The excavator according to claim 1, wherein the control valve further includes a boom-use first spool valve configured to control a flow rate of the hydraulic oil flowing from the hydraulic pump to a boom cylinder and a flow rate of the hydraulic oil flowing from the boom cylinder to a hydraulic oil tank, the first spool valve is configured to control a flow rate of the hydraulic oil flowing from the hydraulic actuator to the hydraulic oil tank, the hydraulic actuator is an arm cylinder, and the second spool valve is disposed between the boom-use first spool valve and the first spool valve in the valve block.

3. The excavator according to claim 2, wherein the hydraulic oil flowing through the bridge pipeline reaches the first spool valve through an arm-use bridge pipeline.

4. The excavator according to claim 3, wherein the control device determines whether a composite operation of an arm and a boom is being performed, and reduces an opening area of the second spool valve upon determining that the composite operation is being performed.

5. The excavator according to claim 3, wherein a check valve is provided between the arm-use bridge pipeline and the center bypass pipeline.

6. A control valve provided in a hydraulic system of an excavator, the hydraulic system including a hydraulic pump connected to an engine of the excavator, and a hydraulic actuator driven by hydraulic oil discharged by the hydraulic pump to move a work element of the excavator, the control valve comprising:

a valve block;

a first spool valve disposed in a center bypass pipeline, the first spool valve being configured to control a flow rate of the hydraulic oil flowing from the hydraulic pump to the hydraulic actuator by controlling communication and blockage between the bridge pipeline and a pipeline to the hydraulic actuator, the hydraulic oil flowing from the hydraulic pump to the hydraulic actuator via a bridge pipeline, of which at least one portion of the bridge pipeline is formed in a plane that is orthogonal to a plane in which the center bypass pipeline extends; and a second spool valve disposed in a parallel pipeline that is parallel to the center bypass pipeline, the second spool valve being configured to control a second flow rate of the hydraulic oil flowing from the hydraulic pump to the hydraulic actuator, wherein the first spool valve and the second spool valve are disposed in the valve block, the center bypass pipeline, the bridge pipeline, and the parallel pipeline art formed in the valve block of the control valve, the pipeline to the hydraulic actuator and at least one portion of the bridge pipeline are formed in a plane that is orthogonal to a plane in which the center bypass pipeline and the parallel pipeline extend, the second spool valve is disposed upstream of the first spool valve for which the first flow rate is, limited by the second spool valve, and an opening area of the second spool valve is adjusted by the movement of a second spool, the hydraulic oil from the second spool valve is supplied to the first spool valve via the bridge pipeline, the second spool of the second spool valve is shorter than a first spool, of the first spool valve, and control pressure is applied to a pilot pressure port formed at one end of the second spool valve to control the second flow rate of the hydraulic oil, and the first spool and the second spool valve are disposed such that the axis lines thereof are parallel to each other.

7. The control valve according to claim 6, wherein the control valve further includes:

a boom-use first spool valve configured to control, a flow rate of the hydraulic oil flowing from the hydraulic pump to a boom cylinder and a flow rate of the hydraulic oil flowing from the boom cylinder to a hydraulic oil tank, the first spool valve is configured to control a flow rate of the hydraulic oil flowing from the hydraulic actuator to the hydraulic oil tank, the hydraulic actuator is an arm cylinder, and the second spool valve is disposed between the boom-use first spool valve and the first spool valve in the valve block.

8. The control valve according to claim 7, wherein the hydraulic oil flowing through the bridge pipeline reaches the first spool valve through an arm-use bridge pipeline.

9. The control valve according to claim 8, wherein a check valve is provided between the arm-use bridge pipeline and the center bypass pipeline.

* * * * *